US006601944B1

(12) United States Patent
Kawazoe

(10) Patent No.: US 6,601,944 B1
(45) Date of Patent: Aug. 5, 2003

(54) IMAGE PRINTING APPARATUS

(75) Inventor: Kenji Kawazoe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 09/633,257

(22) Filed: Aug. 4, 2000

(30) Foreign Application Priority Data

Aug. 11, 1999 (JP) ..... 11-227942
Jul. 18, 2000 (JP) ..... 2000-217757

(51) Int. Cl.[7] ..... B41J 19/18
(52) U.S. Cl. ..... 347/37
(58) Field of Search ..... 347/37; 400/319, 400/320, 321, 322

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,459,600 | A | 7/1984 | Sato et al. |
| 4,463,359 | A | 7/1984 | Ayata et al. |
| 4,558,333 | A | 12/1985 | Sugitani et al. |
| 4,608,577 | A | 8/1986 | Hori |
| 4,723,129 | A | 2/1988 | Endo et al. |
| 4,740,796 | A | 4/1988 | Endo et al. |
| 5,175,563 | A | 12/1992 | Fushimoto et al. |
| 5,450,106 | A | 9/1995 | Morioka et al. |
| 5,871,291 | A | 2/1999 | Kawazoe |

FOREIGN PATENT DOCUMENTS

| | | |
|---|---|---|
| EP | 0 300 823 | 1/1989 |
| EP | 0 841 168 | 5/1998 |
| JP | 54-056847 | 5/1979 |
| JP | 59-123670 | 7/1984 |
| JP | 59-138461 | 8/1984 |
| JP | 60-071260 | 4/1985 |
| JP | 62-226007 | 10/1987 |
| JP | 05-298628 | 11/1993 |

*Primary Examiner*—Huan Tran
(74) *Attorney, Agent, or Firm*—Fitzpatrick, Cella, Harper & Scinot

(57) ABSTRACT

An image printing apparatus according to the present invention, includes a unit for conveying a printing medium and a unit for scanning a carriage to move across the direction in which the printing medium is conveyed by the printing medium conveying unit, the carriage being attached with a printing head for printing an image on the printing medium, the image printing apparatus further comprises a scale disposing along the direction of scanning of the carriage by the scanning unit, a sensor for detecting the position of the carriage to the scale, the sensor being mounted on the carriage opposing to the scale, and a cover for covering the sensor and at least a part of the scale adjoining the sensor, the cover including ribs 41*a* and 41*b* for guiding the scale to predetermined position with respect to the sensor, thereby resolving the problem that the printing of high-quality image on the printing medium is hindered by the foreign matters such as the paper dust, common dust, mist and the like adhering to the surface of the scale and the sensor.

12 Claims, 12 Drawing Sheets

IMAGE PRINTING APPARATUS

This application is based on Japanese Patent Application Nos. 11-227942 (1999) filed Aug. 11, 1999, and 2000-217757 (2000) filed Jul. 18, 2000, the content of which is incorporated hereinto by reference.

BACKGROUND OF THE INVENTION

1. Field of the Invention

The present invention relates to an image printing apparatus for printing various kinds of image information in personal computers, word processors, electronic typewriters, facsimiles or the like.

2. Description of the Prior Art

Recently, office automation equipment, such as personal computers and word processors, has come to be used widely in individual households. It is becoming commonplace for the users of this kind of equipment to upload photoprints, process and output images or the like by using input means such as a digital camera and a film scanner.

Under such circumstances, the image printing apparatus, as one of the various output means, is increasingly required to be provided with the ability to output a high-quality image such as the photoprint, and it has been improved in various aspects in order to meet such requirement. At present, a so-called serial-type image printing apparatus designed for obtaining a desired print by scanning a printing medium with a printing head is prevailing mainly due to the printing cost. A means for improving the quality of the image obtainable by the serial-type image printing apparatus is to improve the positioning accuracy of the printing head relative to the printing medium.

In a serial-type image printing apparatus, the printing head is attached to a carriage, and the carriage is moved, for scanning, in a breadthwise direction of the printing medium by a stepping motor. The printing head is driven correspondingly to the timing of the driving operation of the stepping motor to effect the printing operation of the printing head to the printing medium. Is this case, in order to scan the carriage at a constant speed, it is necessary for the stepping motor to be driven with a constant revolution. The amount of revolution of the stepping motor and the scanning movement of the carriage do not necessarily have a one-to-one relationship because of structural factors such as the delay of the rotor relative to the excitation phase of the stepping motor or the vibration of the cogged belt for coupling the stepping motor and the carriage. In other words, driving the printing head correspondingly to the driving revolution of the stepping motor does not necessarily assure the formation of good images.

Therefore, in order to resolve the problem of a decrease in imaging quality caused by the previously mentioned structural factors, it is necessary to detect the absolute position of the carriage, on which the printing head is attached, so that the printing head can be driven correspondingly to the detection signal.

As for the method for detecting the absolute position of the carriage, it is a common practice to read, by means of an optical or magnetic sensor mounted on the carriage, the position of the carriage on the basis of the linear encoder scale, which covers the full stroke of the carriage.

FIG. 12 shows a schematic illustration of the carriage in a conventional image printing apparatus. In this illustration, a guide shaft 104, for defining the direction of scanning movement of the carriage 102, slidably passes through a guide bush 103, which is provided at the rear end of the carriage 102, whereon a printing head 101 is attached for forming image on a printing medium (not shown). The carriage 102 is made to move for scanning along the guide shaft 104 when the cogged belt (not shown), connected with the carriage 102, is driven. The linear encoder scale 105 provided in parallel with the guide shaft 104, consists of a transparent PET (polyethylene terephthalate) web with black scale printed thereon at predetermined intervals. A printed circuit board 106 mounted at the rear end of the carriage 102 is provided not only with various devices, such as a capacitor 107, for driving the printing head 101 but also with an optical encoder sensor 108 for detecting the position of the carriage 102 by optically reading the scale on the linear encoder scale 105.

The position of the carriage 102 with respect to the linear encoder scale 105 can be determined accurately by reading the scale printed on the linear encoder scale 105 by using the encoder sensor 108 while the carriage 102 is moving for scanning. Any desired image can be printed on the printing medium by driving the printing head 101 correspondingly to the detection signal.

In the case of the conventional image printing apparatus illustrated in FIG. 12, the paper dust produced by the friction occurring during the transfer of the printing medium or the common dust, occurring depending on its location, accumulates on the linear encoder scale 105 and the encoder sensor 108. Especially, in the case of the ink-jet printer, the ink and the treatment liquid for adjusting the printability of the ink to the printing medium, which are discharged from the printing head, form floating mist to accumulate on the linear encoder scale 105 and the encoder sensor 108. As a result, during the long use of the image printing apparatus, foreign matters such as previously mentioned paper dust, common dust or the mist adheres to the linear encoder scale 105, thereby not only making the linear encoder scale 105 hard to be read accurately but also making it difficult to print high-quality image on the printing medium.

When using a magnetic-type encoder as the linear encoder scale 105, the adhesion of foreign matters such as the paper dust, common dust and mist can be prevented by closely attaching a cover to the linear encoder scale. This type of image printing apparatus is disclosed in Japanese Patent Application Laid-open No. 5-298628 (1993) and U.S. Pat. No. 5,450,106. However, when an optical-type encoder is adopted, if the cover is closely provided with the linear encoder scale, there is the possibility that the linear encoder scale is damaged or contaminated widely by the paper dust, common dust or the mist. And, this can adversely affect the accurate reading by the encoder sensor.

SUMMARY OF THE INVENTION

The object of the present invention is to provide an image printing apparatus capable of printing high-quality images on the printing medium over a long period of time not only by preventing the foreign matters such as the paper dust, common dust or the mist from adhering to the scale or the sensor but also by preventing the linear encoder scale from being damaged.

An image printing apparatus according to the present invention includes means for conveying a printing medium and means for scanning a carriage to move across the direction in which the printing medium is conveyed by the printing medium conveying means, the carriage being attached to a printing head for printing an image on the printing medium, the image printing apparatus comprising:

a scale disposed along the direction of scanning of the carriage by the scanning means, a sensor for detecting the position of the carriage relative to the scale, the sensor being mounted on the carriage opposite to the scale, and a cover for covering the sensor and at least a part of the scale adjoining the sensor, the cover being provided with a guide portion for guiding the scale to a predetermined position with respect to the sensor.

According to the present invention, because the image printing apparatus comprises the cover for covering the sensor which is provided with the carriage so that the sensor opposes the scale disposed along the direction of scanning of the carriage, with the cover being provided with a guide portion for guiding the scale to a predetermined position with respect to the sensor, foreign matters such as the paper dust, common dust or the like adheres only on the surface of the cover, preventing them from adhering to the sensor and the scale. The scale is guided to a predetermined position relative to the sensor by the guide portion of the cover to enable accurate reading of the scale, and as a result, reliable and high-quality printing of images can be obtained by the image printing apparatus over a long period of time.

In the image printing apparatus according to the present invention, the cover may be mounted on the carriage, the cover also may be disposed for covering the full length of the carriage. In the case the cover is provided to cover the full length of the carriage, the cover preferably includes a slit for permitting the sensors to pass through. At least a part of the cover may be formed from an elastic material or conductive material. In case the cover is formed from a conductive material, the adhering of the dust to the cover due to the effect of the static electric charge can be inhibited.

In the case the guide portion of the cover is provided so as to prevent the sensor from coming into contact with the scale, the scale can be protected from being scratched as the result of the contact between the scale and the sensor or the foreign matter.

The guide portion is preferably designed so as to be able to prevent the contact between the sensor and the scale even during the movement of the carriage for scanning. Further, the guide portion is preferably opposed to the scale so that the part of the scale corresponding to the reading center of the sensor is interposed with respect to the guide portion.

The area of the central portion of the cover may be made larger than that of the opening end of the cover through which the scale passes. In this case, the incursion of the foreign matter into inside of the cover can be prevented more effectively for better protection of the sensor and the scale.

An absorption member may be received within the cover. Thereby, this absorbing member catches the foreign matter invading within the cover to prevent them more effectively from adhering to the sensor or the scale.

The image printing apparatus may also comprise opening/closing means for opening/closing the opening end of the cover through which the scale passes. In case the opening/closing means is provided, the dust and the like can be prevented from entering within the cover while the image printing apparatus is not operating, thereby preventing the dust and the like from adhering to the sensor and the scale. In this case, means for controlling the opening/closing means so that the opening end of the cover can be closed during the operation of the carriage scanning means is not activated.

The printing head may be a liquid ejecting head having an ejecting port for ejecting liquid. In this case, the liquid ejecting head may include an ejecting energy generator for generating the energy to eject liquid from the ejecting port. The ejecting energy generator may include an electrothermal transducer for generating thermal energy through the film boiling of the liquid. The liquid may be ink and/or a treating liquid for adjusting the printability of the ink to be ejected onto the printing medium.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Although some embodiments of the present invention applied to the ink jet printer now will be described referring to FIGS. 1 to 11, the present invention is not limited to these embodiments and can be applied in other fields of art, including similar problems, in the case of a rotating element detected with a rotary encoder.

Figure 1:
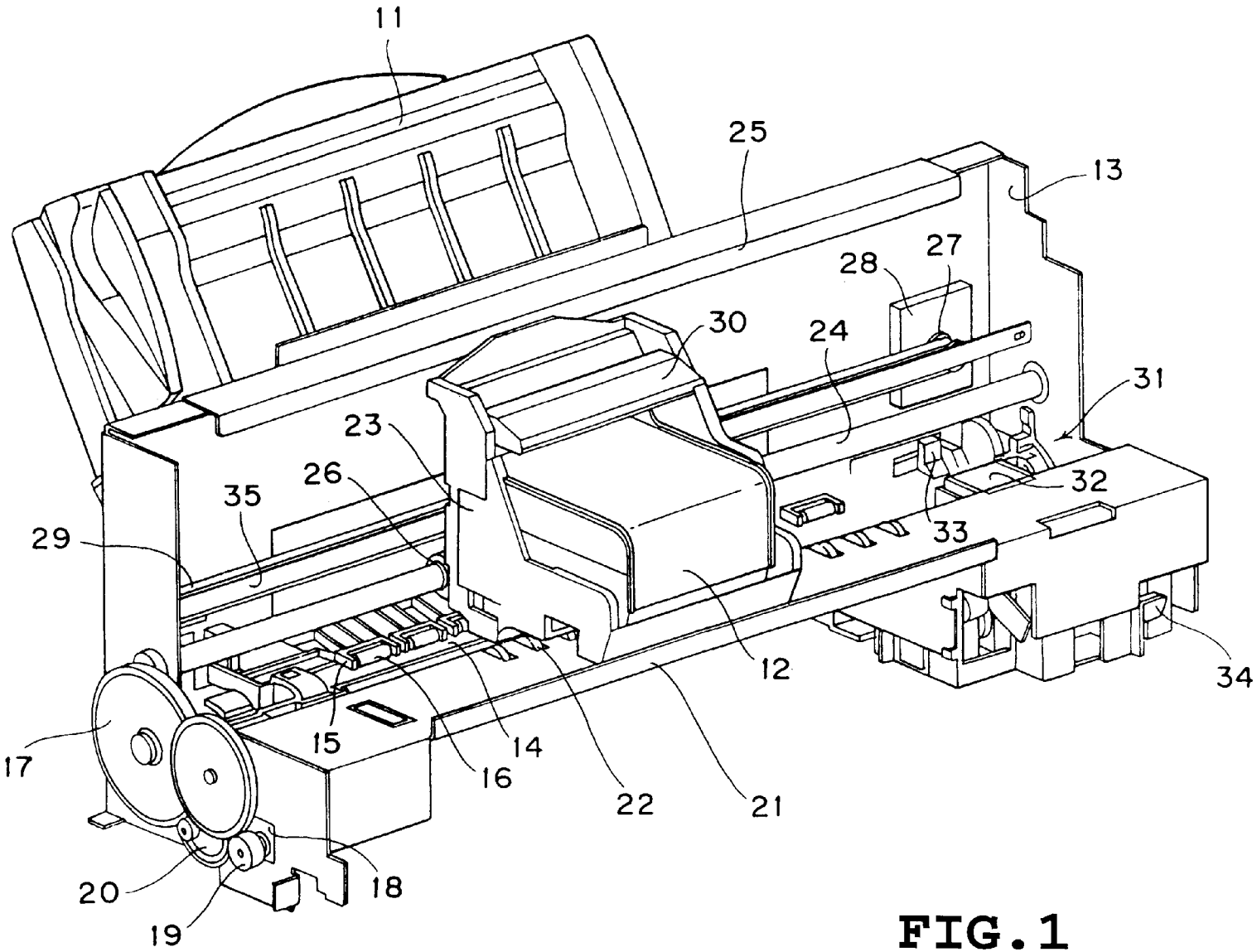
FIG. 1 is a perspective view showing the external features of an ink jet printer applied as an embodiment of the image printing apparatus according to the present invention.
Figure 2:
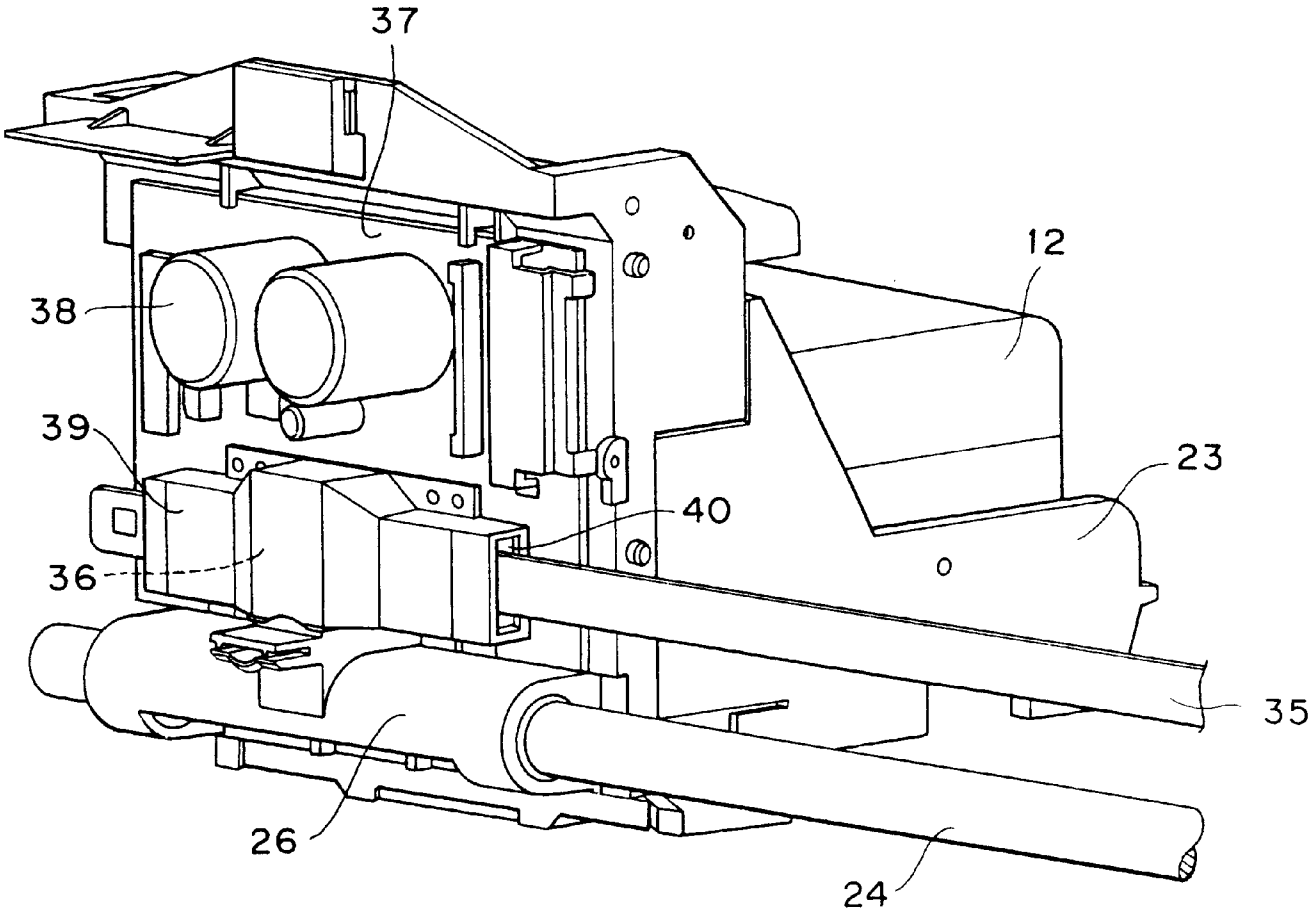
FIG. 2 is an enlarged perspective view of the back of the carriage of the ink jet printer shown in FIG. 1.

The appearance of the present embodiment is shown in FIG. 1, while the back view of the principal part thereof is shown in FIG. 2. More particularly, a loading chute 11, for loading the printing medium such as a loose paper (not shown), is provided with a side-end guide portion for regulating the position of the printing medium in the direction of its width by abutting one side end of the printing medium. There is provided, under the lower-end side of the loading chute 11, a feed roller (not shown) for feeding the printing medium one by one towards an ink jet head 12, which will be described later. The lower end of the printing medium loaded on the loading chute 11 is kept pressed towards the side of the feed roller by a forcing means (not shown).

A printing medium conveying roller 14, attached together with the feed roller to a casing 13 of the ink jet printer, is disposed on the downstream side of the printing medium conveying line beyond the feed roller. A pinch roller 16 is disposed right above the printing medium conveying roller 14, the pinch roller 16 being rotatably mounted on a pinch roller holder 15, which is displaceable in the opposite direction to the printing medium conveying roller 14. A forcing means (not shown) for pressing the pinch roller 16 against the printing medium conveying roller 14 is connected to the pinch roller holder 15. A follower gear 17 is integrally mounted on one end in the longitudinal direction of the printing medium conveying roller 14. The follower gear 17 meshes a drive gear 19 of a printing medium driving motor 18 mounted on the casing 13 through an idle gear 20. This idle gear 20 meshes follower gear 17 fixed to one end of the printing medium discharging roller (not shown). A spur-like wheel 22, held rotatably by a rotatable spur holder 21, is located in the opposite direction to and right above the printing medium ejecting roller. The spur holder 21 is connected to a forcing means (not shown) for pressing the wheel 22 to the printing medium ejecting roller.

Thus, when the medium driving motor 18 is electrified to drive the feed roller, the conveying roller 14 and the medium discharging roller are driven, the printing medium loaded on the loading chute 11 is fed one by one so that the printing medium is fed intermittently along its conveying line correspondingly to the scanning movement of the carriage 23, which will be described later.

A guide bar 24 and the guide rail 25, extending in parallel with each other in the widthwise direction of the printing medium, are fixed, at both ends of each, to the casing 13 of the ink jet printer, respectively. The carriage 23 is slidably connected along the longitudinal direction of the guide bar 24, with the guide bar 24 through a slide bearing 26 attached to the carriage 23. A pair of sprockets 27 (one of the pair is not shown) are rotatably mounted on the casing 13 at the portions thereof corresponding to both the longitudinal ends of the guide bar 14. One of the sprockets 27 is connected with a carriage driving motor 28 to be driven thereby for revolution. A cogged belt 29 is wound round the pair of sprockets 27, and a part of the cogged belt 29 is connected with the carriage 23.

Therefore, when the carriage driving motor 28 is electrified to turn the cogged belt 29, the carriage 23, connected with the cogged belt 29, is made to move for scanning along the guide bar 24 and guide rail 25 in the direction orthogonal to the printing medium conveying line.

An ink jet head 12 is detachably attached on the carriage through a head attaching/detaching control lever 30. Ink jet head 12, when attached properly on the carriage 23, has its ejecting port opening downward. The ejecting port is disposed traversing the conveying line disposed between the medium conveying roller 14 and the medium ejecting roller.

The guide bar 24 is made movable in the direction for receding from the conveying roller 14 by means of a cam (not shown), that is, in the direction for approaching the guide rail 25. For this purpose, both the carriage 23 and the ink jet head 12 attached to this carriage 23 are designed to be replaceable in the direction for receding from the printing medium. By being designed so, the contact of the printing medium and the ink jet head can be prevented. The printing medium is available in various kinds differing in the tendency of curling, creasing, folding and the like. With such different tendencies, there is the possibility that the printing medium may be contaminated by the ink when the printing medium comes into contact with the ink jet head due to the effect of the curling or creasing of the printing medium.

The interval between the ink jet head and the printing medium can be increased further by about 1 mm with respect to the usual printing position at the previously described receded position.

A recovery unit 31, for discharge recovery processing of the ink jet head 12, is provided on a portion, corresponding to one end of the scanning movement of the carriage 23, of the casing 13. The recovery unit 31, according to this embodiment, comprises a capping member 32, formed from an elastic material such as the rubber for covering the ejecting port surface of the ejecting port to which the ink jet head 12 opens, and a wiping blade 33 for wiping off the liquid or the like remaining on the ejecting port surface of the ink jet head 12 disposed in proximity to the capping member 32. The capping member 32 is connected with a suction pump 34 through a piping (not shown). A space surrounded by the capping member 32 and the ejecting port surface of the ink jet head 12 is kept in a negative pressure while the suction pump 34 is in operation. In this condition, an air bubble in the ink jet head 12 and the liquid in the liquid passage communicating with the ejecting port, which has become unsuitable for printing because of the increase in viscosity of the liquid, and the treating liquid for adjusting the printability of the ink itself and that to the printing medium are drawn outside passing the capping member 32, thereby keeping the ink jet head 12 in a normal condition.

A linear encoder scale 35 (hereinafter referred to simply as "the scale"), which one end is fixed to the casing 13, extends in parallel to the guide bar 24 to have its other end fixed to the casing 13 through a leaf spring (not shown). The scale 35 in the present embodiment is a transparent PET film with black scale printed thereon at predetermined intervals; therefore, an optical-type encoder is adopted as a corresponding linear encoder sensor 36 (hereinafter referred to simply as "the sensor"). However, it is possible to adopt another type of linear encoder such as the magnetic type.

The sensor 36 for reading the scale printed on the scale 35 is mounted, together with a capacitor 38 for driving the ink jet head 12 and others, on a substrate 37, which is attached to the carriage 23. The substrate 37 is mounted with a sensor 36 and a cover 39 which at least partially covers the scale 35 disposed in proximity to the sensor 36.

Figure 3:
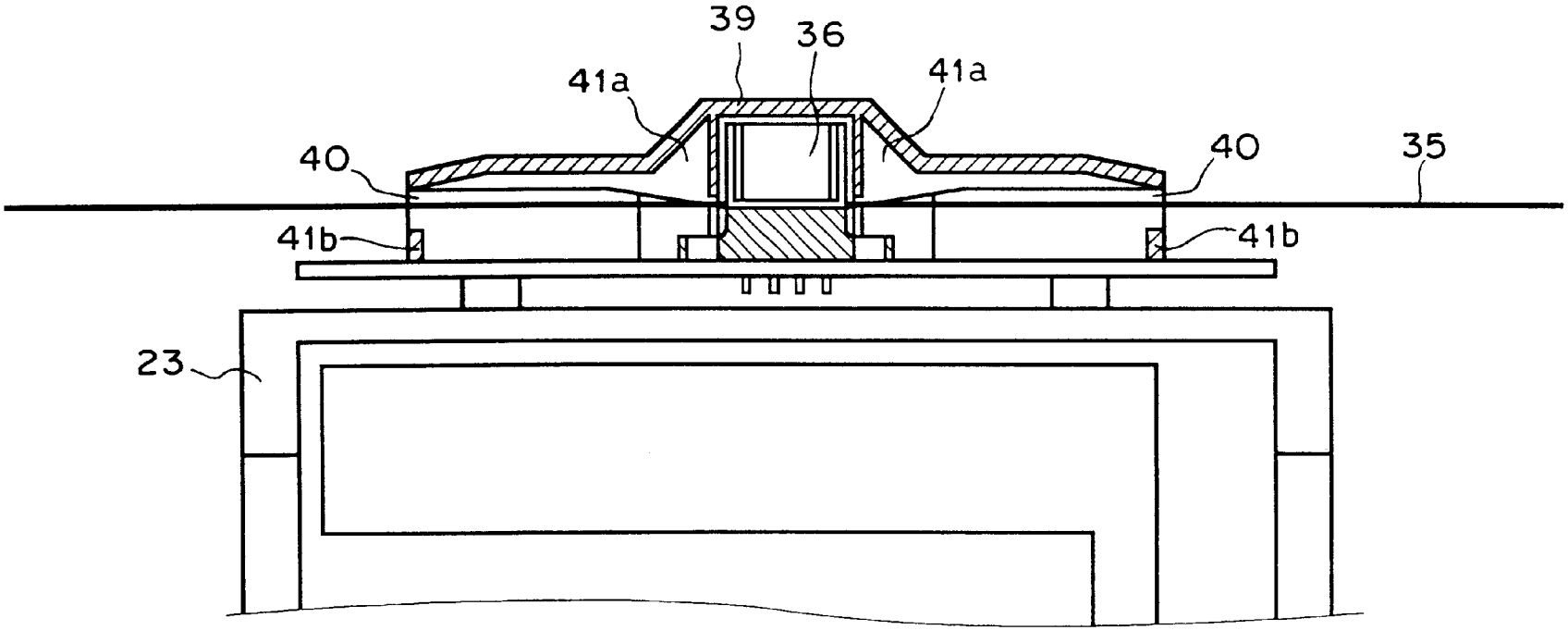
FIG. 3 is an enlarged sectional view showing the backside of the cover in the embodiment shown in FIG. 1.
Figure 4:
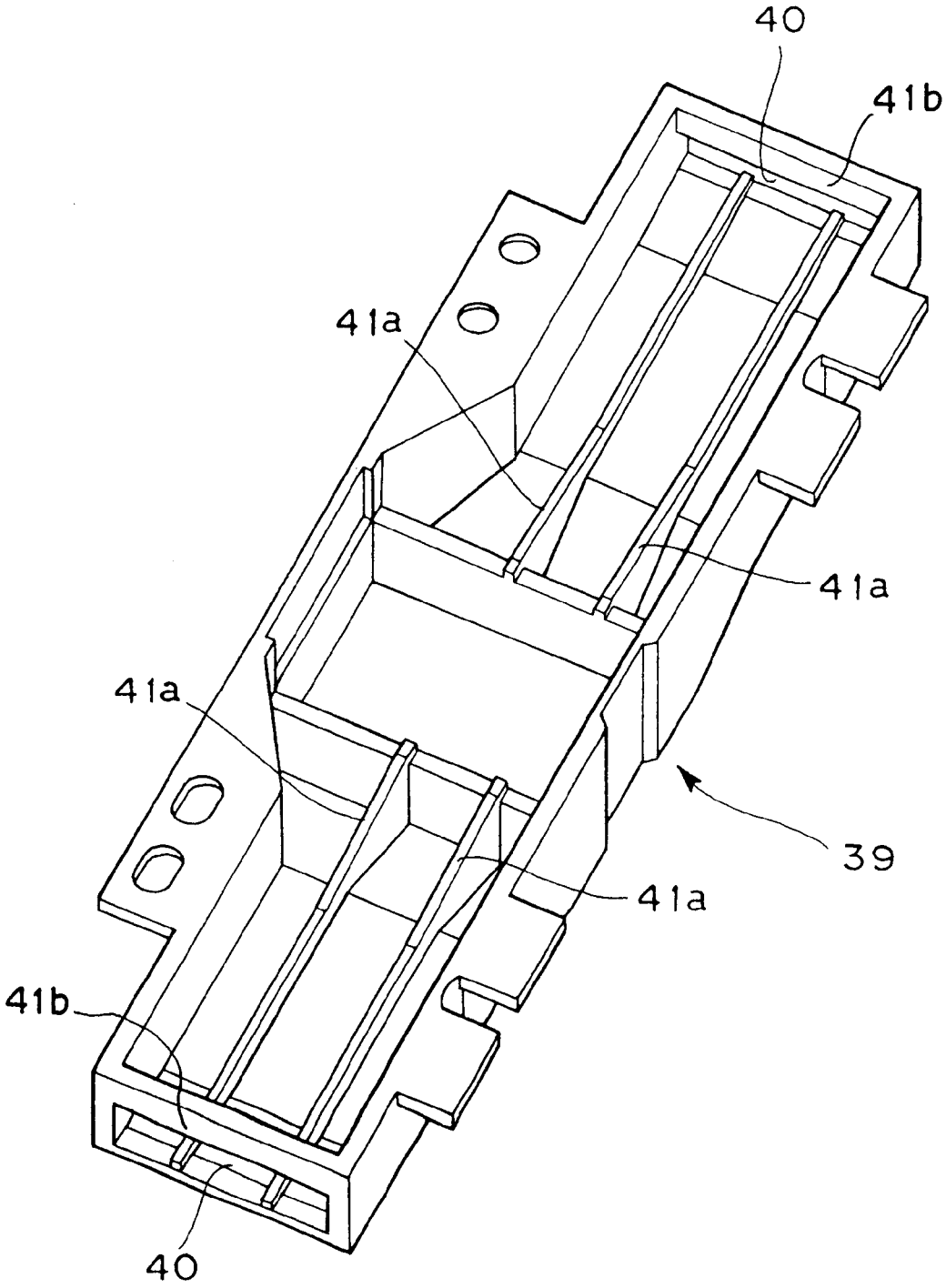
FIG. 4 is a perspective view showing the external features of the cover in the embodiment shown in FIG. 1.

FIG. 3 is a sectional view partially showing the cover 39, while FIG. 4 shows its external appearance. More particularly, the cover 39 in the present embodiment has a pair of openings 40 formed at both ends of traveling span for scanning of the carriage 23, one at one end and the other at the other end, respectively. The scale 35 passes through openings 40 of the cover 39. It is desirable for the sizes of openings 40 to be reduced as far as possible depending on the size and form of the scale 35. However, since the sensor 36 is contained in the middle portion of the cover 39, it is desirable for this middle portion of the cover 39 to have sectional areas sufficiently larger than those of openings 40, which are perpendicular to surface of the paper and parallel to the plane orthogonal the scale 35. The length of the cover 39 along the direction of movement for scanning of the carriage 23 is made more than 2 times the dimension of the sensor 36 in the direction of its movement for scanning, whereby the dust or the mist reaching the sensor 36 is reduced to a largest possible extent even when it has entered inside the cover 39 through the openings 40.

Figure 5:
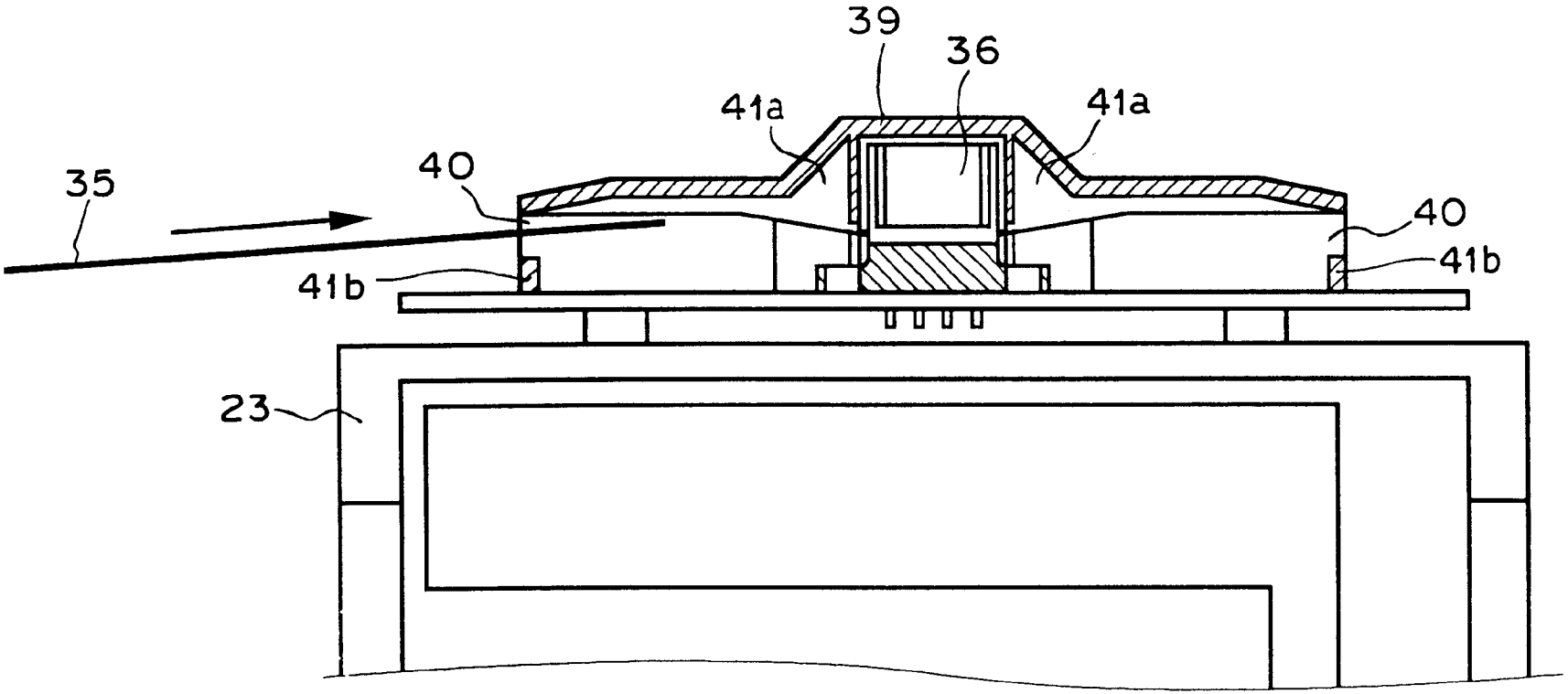
FIG. 5 is an enlarged sectional view showing the manner in which the scale is mounted in the embodiment shown in FIG. 1.

The inside wall of the cover 39 is provided with a guide rib 41*a* for guiding the front end of the scale 35 so that the scale 35 can easily be passed from one opening 40 to the other opening 40 through the inside of the cover 39 when assembling the ink jet printer. FIG. 5 shows how to dispose the scale 35 with respect to the cover 39. That is, when passing the scale 35 from one opening 40 to the other opening 40 of the cover 39 following the mounting of the carriage 23 on the guide bar 24 and the guide rail 25, the front end of the scale 35 can easily be guided to the other opening 40 by utilizing the guide rib 41*a*, thereby facilitating the assembly work.

Figure 6:
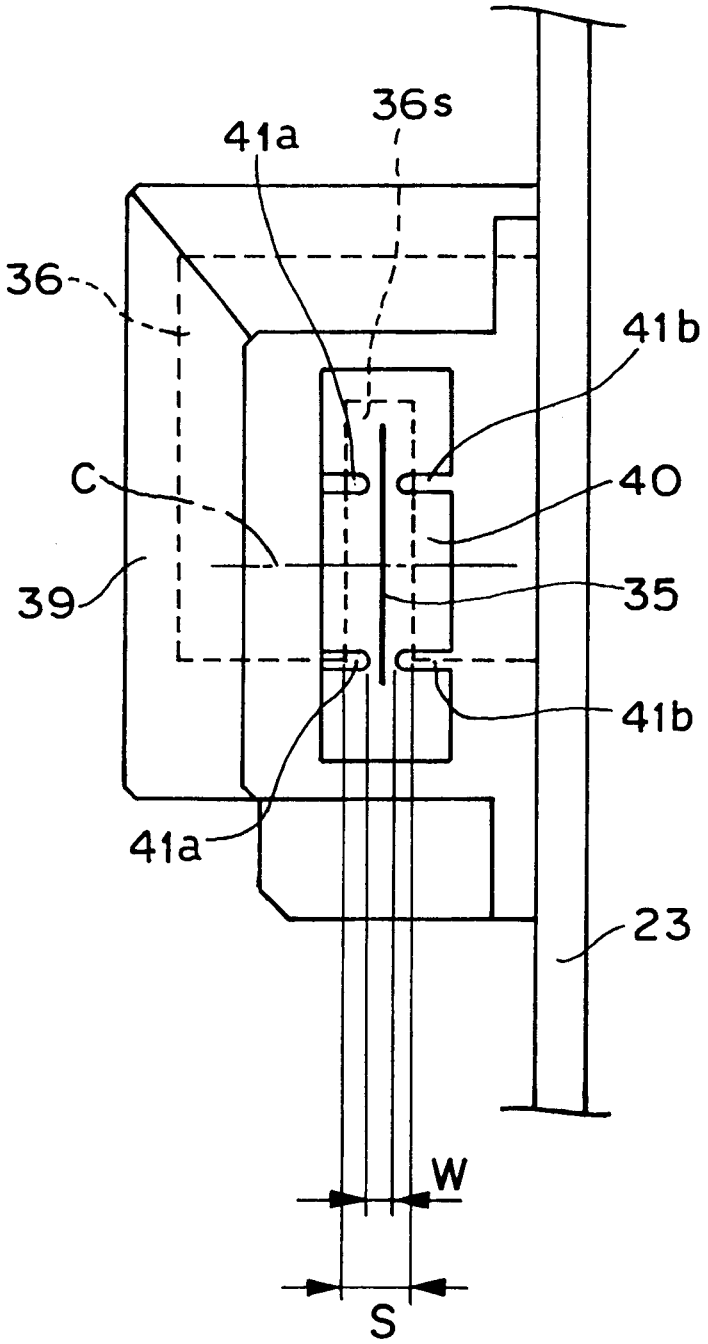
FIG. 6 is an elevation of the opening of the cover in the embodiment shown in FIG. 1.

FIG. 6 is an enlarged view of the opening 40. The openings 40 are partially provided with a guide rib 41*b*. The interval W between the opposing guide rib 41*a* and the above-mentioned guide rib 41*b* is made smaller than the width S of a slit-like scale passage 36*s* formed downward with respect to the sensor 36, which is shown by dotted line in FIG. 6. With this arrangement the scale 35 is prevented from coming into direct contact with the sensor 36. Being formed from the PET film or the like, the scale 35 generates static electricity that is harmful to the sensor 36 when sliding against the sensor 36 while in contact therewith.

In the present embodiment, each of the guide ribs 41*a* and 41*b* are formed so that one is formed on the upper side and the other is formed on the lower side, respectively. With this arrangement, even if the scale 35 comes into contact with either one of the guide ribs 41*a* or 41*b*, the scale 35 can be kept parallel to or substantially parallel to its original position. If the ribs 41*a* and 41*b* are provided one by one, the scale 35 becomes unable to keep itself straight because of being unable to be supported at two points, causing the possibility of inaccurate reading.

Figure 7:
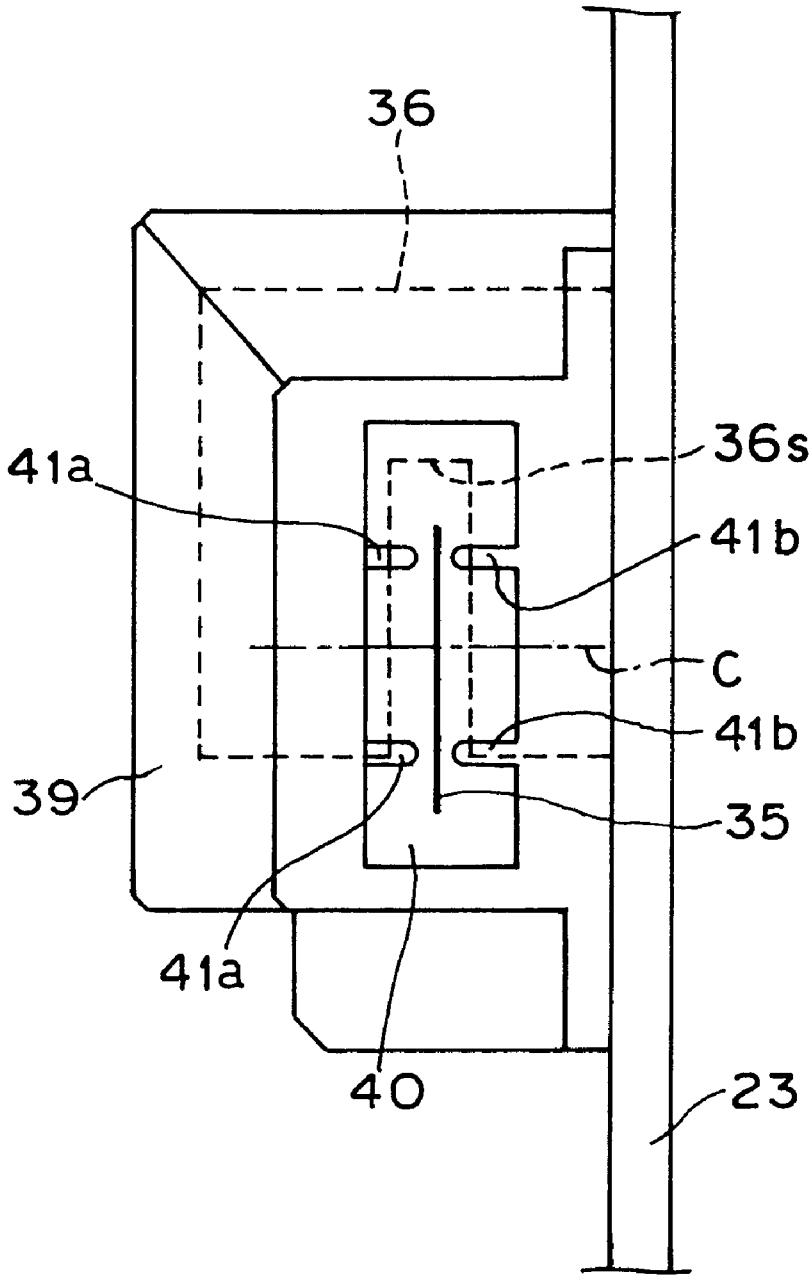
FIG. 7 is an elevation of the opening of the cover, similar to it shown in FIG. 6, showing the condition in which the carriage, together with the printing head, is at the receded position from the printing medium.

In FIG. 6, the dot-dashed line C represents an optical central axis of the reading by an optical type encoder sensor 36. The guide ribs 41*a* and 41*b* are arranged so as not to be disposed near the optical central axis. As mentioned previously, the interval between the ink jet head 12 on the carriage 23 and the printing medium can be set for the interval for ordinary printing position and the interval for receded position from the ordinary printing position. FIG. 7 shows the condition in which the ink jet head 12 on the carriage 23 and the printing medium is at receded position from the printing medium.

In the present embodiment, for reducing the manufacturing cost, not only the position of the scale 35 is fixed but also the carriage 23 can be retracted from the printing medium. In this case, compared with the ordinary printing position shown in FIG. 6, the sensor 36 is displaced upward by about 1 mm with respect to the scale 35 at the retracted position shown in FIG. 7. Even in this condition, each of the guide ribs 41*a* and 41*b*, one being provided at the upper side and the other being provided at the lower side, respectively, are disposed so as to oppose the scale 35, and the positions at which the guide rib 41*a* and 41*b* come into contact with the scale in the condition shown in FIG. 6 are made not to be disposed opposite to the optical center 36*a* in the condition shown in FIG. 7.

The guide ribs 41*a* and 41*b* and 41*b* are disposed so as not coming into contact with the scale 35 during the scanning movement of the carriage 23. If the guide ribs 41*a* and 41*b* or 41*b* should come into contact with the scale 35 during the scanning movement of the carriage 23, the contact areas can be limited to the smallest possible extent so that the previously mentioned condition can be satisfied. Furthermore, the point at which the guide ribs 41*a* and 41*b* or 41*b* comes into contact with the scale 35 differs from actual reading point in the longitudinal direction of the scale 35, and so the reading of the scale 35 is not affected.

Figure 8:
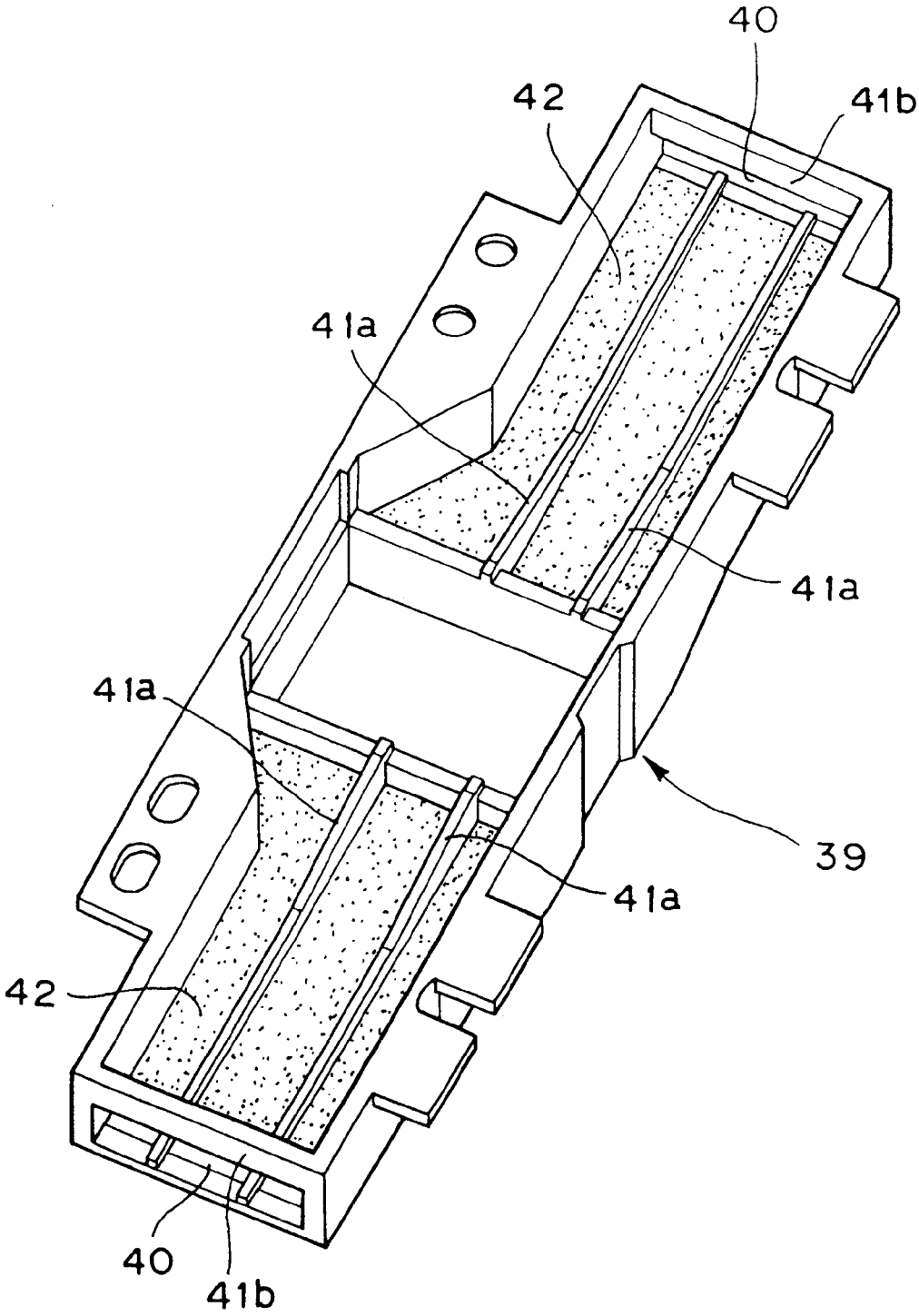
FIG. 8 is a perspective view showing the cover in another embodiment of the image printing apparatus according to the present invention.

As shown in FIG. 8, when an adsorption member 42 made from a charged filter or sponge is attached to the inside wall of the cover 39, the adhering of the dust or the like to the sensor 36 and the scale 35 can be reduced by letting the adsorption member 42 adsorb the dust or the like which has entered inside the cover 39. A better dust-prevention effect can be obtained by providing, within the cover 39, an air passage for creating an air flow forcing the dust and the mist which has entered inside the cover 39 from one of the openings 40 to be discharged from the other opening 40 without reaching the sensor 36.

Further, better dust-prevention effect can be obtained by providing a mechanism that enables the openings 40 to be closed while the ink jet printer is not in a printing operation.

Figure 9:
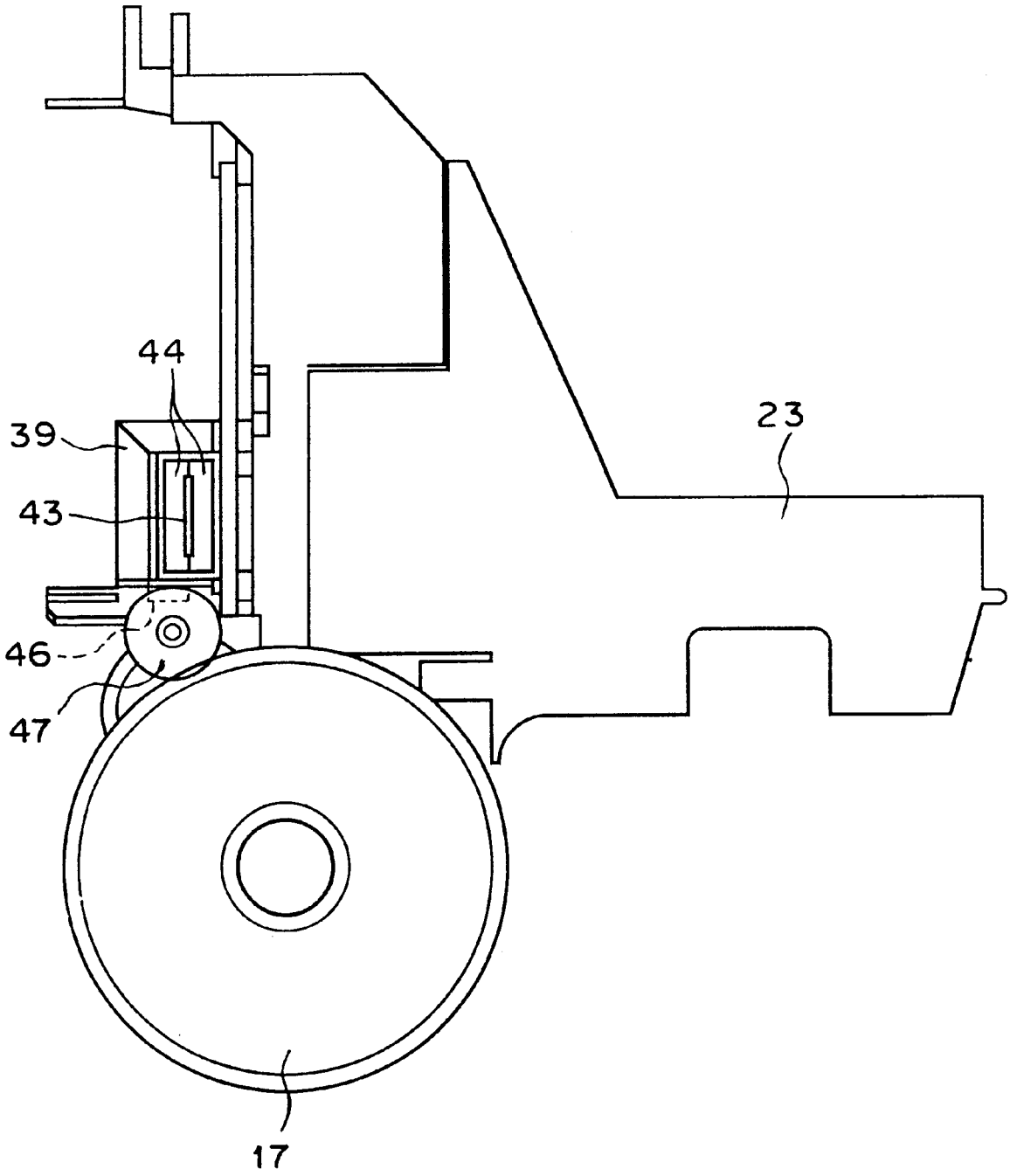
FIG. 9 is a side view showing carriage in other embodiment of the image printing apparatus according to the present invention.
Figure 10:
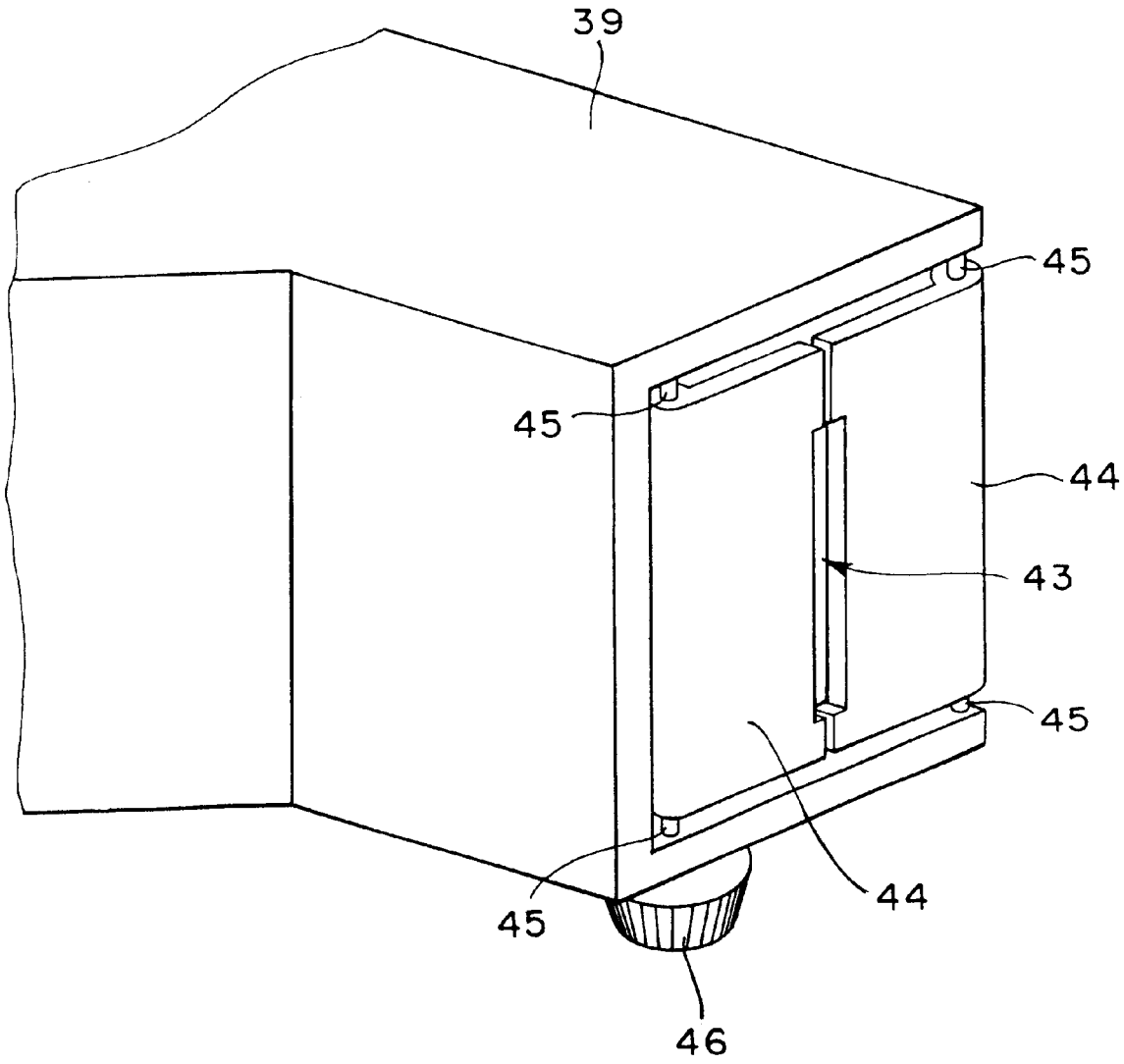
FIG. 10 is an enlarged perspective view of the external features of one end of the cover in the embodiment shown in FIG. 9.

FIG. 9 is a side view of another embodiment of the present invention, while the principal parts thereof are shown in FIG. 10, with the numerals and letters common to those parts which are described in connection with the previous embodiments being omitted. More particularly, each of the two openings 40 of the cover 39 is provided with a pair of cover members 44, having a slot 43 corresponding to the sectional form of the scale 35, pivotally attached thereto by means of a pair of hinges 45. Each pair of hinge pins 45 for each of the two cover members 44 correspondingly pivot for opening or closing the cover members 44 by means of a link mechanism (not shown). One of the pair of hinge pins 45 is connected with a bevel gear 46. A transmission gear 47 is mounted on the casing 13 of the ink jet printer, the transmission gear 47 meshing the follower gear 17 described in connection with the previous embodiment and also with the bevel gear 46 at one end of the travel span for scanning of the carriage 23.

Therefore, in order to open the two pairs of cover members 44 which are closed as shown in FIG. 10 by 90° around the hinge pins 45 respectively, the carriage 23 is made to travel to one end of its travel span to cause the transmission gear 47 to mesh the bevel gear 46 and the medium driving motor 18 to be driven in one direction. To close the two pairs of cover members 44, the medium driving motor is driven in an inverse direction so that the cover members 44 are closed at one end of the travel span of the carriage 23.

In the above embodiment, the cover 39 is attached to a substrate 37 of the carriage 23 for scanning travel, and the sensor 36 and a part of the scale 35 disposed in proximity to the sensor 36 are covered with the cover 39. However, the cover 39 may be mounted on the casing 13 to fully cover the sensor 36 and the scale 35.

Figure 11:
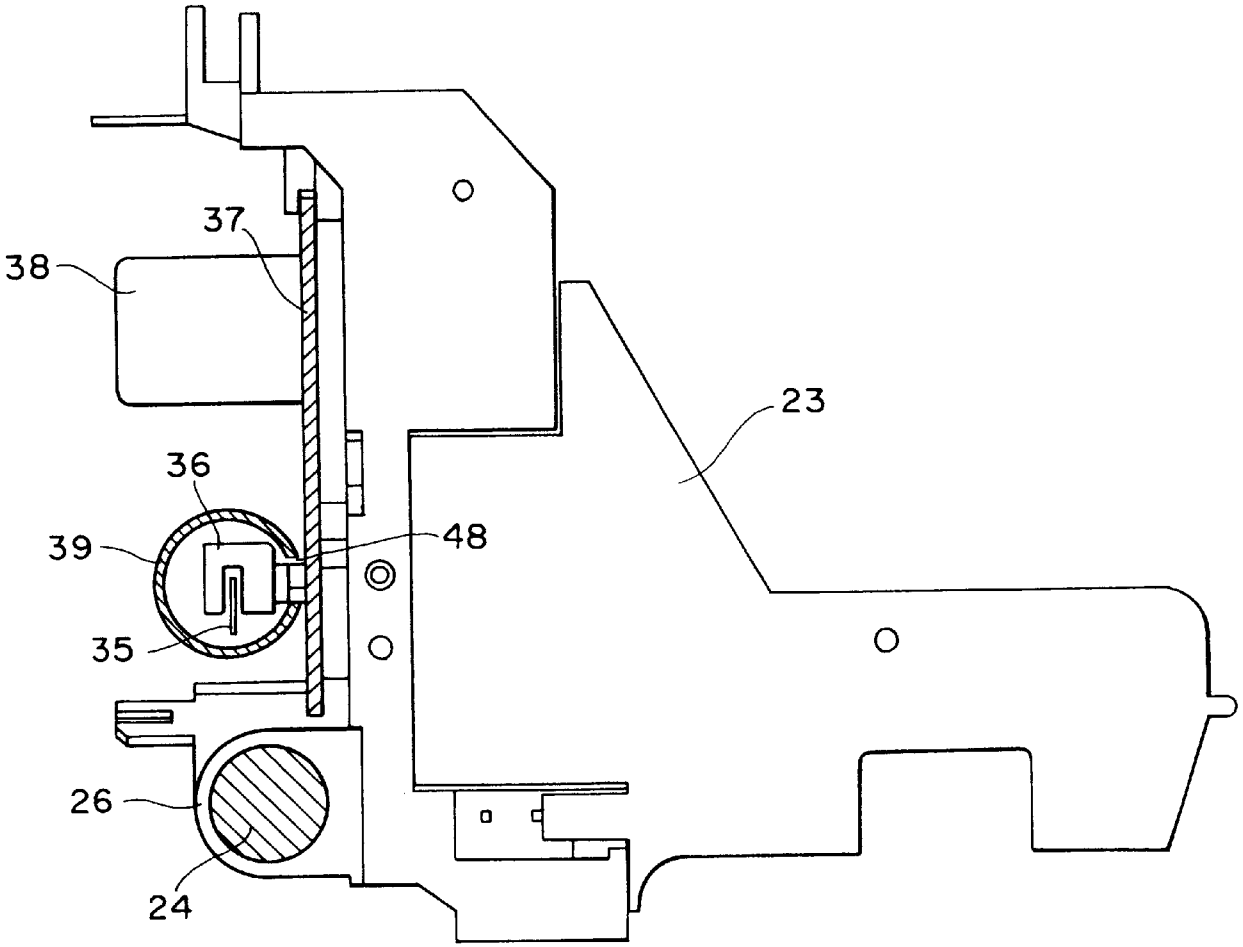
FIG. 11 is a side view showing the principal parts of an ink jet printer as another embodiment of the image printing apparatus according to the present invention.
Figure 12:
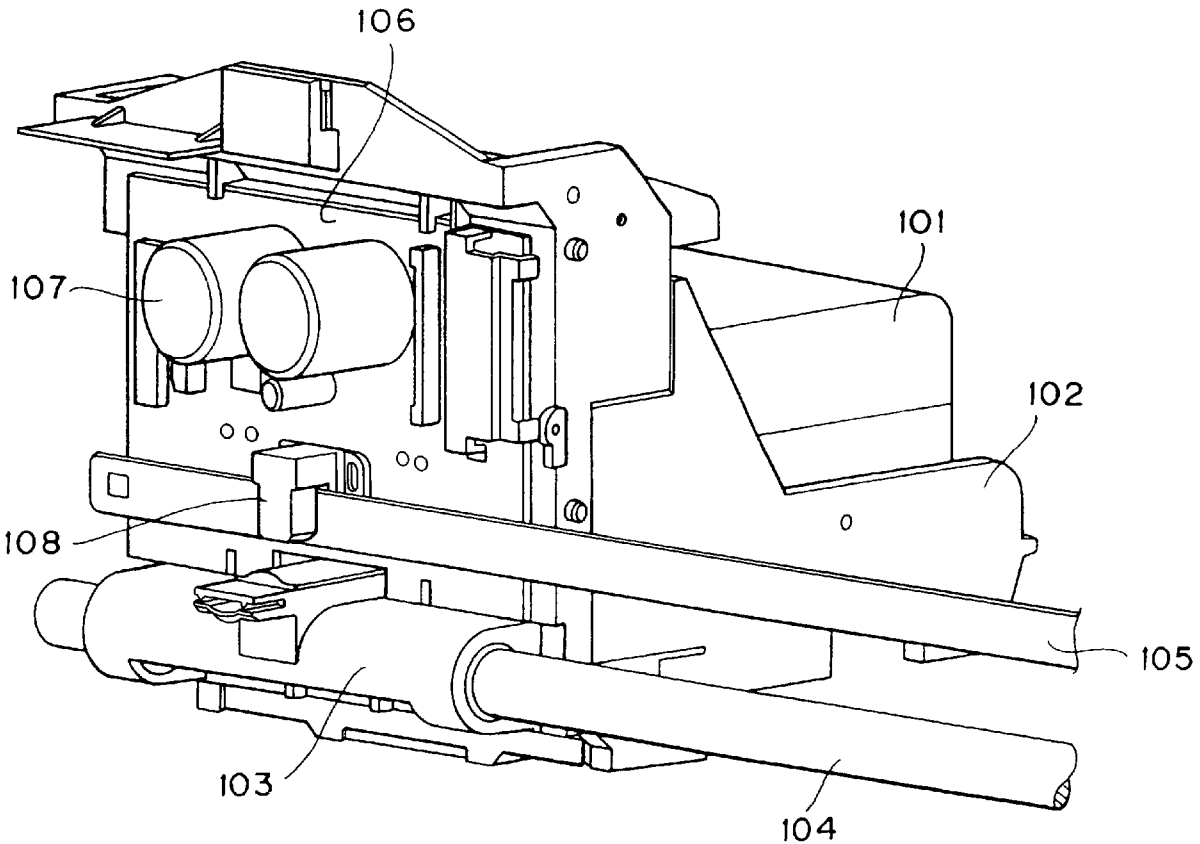
FIG. 12 PRIOR ART
FIG. 12 is an enlarged perspective view showing the backside of the carriage of a conventional ink jet printer.

FIG. 11 is a sectional view of the principal parts of a further embodiment of the present invention, with common numerals and common letters assigned to those parts having common functions to those of the previous embodiment, and the descriptions thereof, being omitted. More particularly, the cover 39 fully covering the sensor 36 and the scale 35 is fixed to the casing (not shown, but refer to FIG. 1) at its two ends. The cover 39 in the present embodiment is provided with a slit 48 substantially throughout its full length for allowing the sensor 36 to pass therethrough. Similarly to the case of the previous embodiment, the sensor 36 is mounted on the substrate 37 attached to the carriage 23.

The slit 48 in the present embodiment opens on the side of the ink jet head 12. However, it is desirable for the slit 48 to be made to open, for example, on the opposite side of the ink jet head 12 or open downward by accordingly designing the bracket with which the sensor 36 is attached to the substrate 37, in consideration of the presence of the floating dust or mist within the ink jet printer.

It is not necessary for the slit 48 to always open throughout the span of the scanning travel of the carriage 23, that is, it is sufficient for slit 48 to open only within the range through which the sensor 36 passes the cover 39. For this reason, the cover 39 is formed into a cylindrical member from an elastic material such as the rubber and is cut along its longitudinal direction to form the slit 48. The sensor 36 is passed through the elastically deformed slit 48, leaving the rest of the slit, which is not forced to open by the sensor 36, kept closed, thereby preventing the infestation of dust or the like.

If there is the possibility that the static electricity is generated as the result of the sliding contact between the scale 35 and the sensor 36, the adhering of the dust or the like can be prevented by forming the cover 39 from a conductive material.

The present invention achieves distinct effect when applied to the image printing apparatus which has means for generating thermal energy such as electrothermal transducers or laser beam, and which causes changes in ink by the thermal energy so as to eject liquid. This is because such a system can achieve a high density and high-resolution printing.

A typical structure and operational principle thereof is disclosed in U.S. Pat. Nos. 4,723,129 and 4,740,796, and it is preferable to use this basic principle to implement such a system. Although this system can be applied either to on-demand-type or continuous-type ink jet printing systems, it is particularly suitable for the on-demand-type apparatus. This is because the on-demand-type apparatus has electrothermal transducers, each disposed on a sheet or liquid passage that retains liquid, and operates as follows: first, one or more driving signals are applied to the electrothermal transducers to cause thermal energy corresponding to printing information; second, the thermal energy induces sudden temperature rise that exceeds the nucleate boiling so as to cause the film boiling on heating portions of the liquid ejecting head; and third, bubbles are grown in the liquid corresponding to the driving signals. By using the growth and collapse of the bubbles, the ink is expelled from at least one of the ejecting ports of the head to form one or more liquid drops. The driving signal in the form of a pulse is preferable because the growth and collapse of the bubbles can be achieved instantaneously and suitably by this form of driving signal. As the driving signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a liquid ejecting head, which is incorporated to the present invention: this structure includes heating portions disposed on bent portions in addition to a combination of the ejecting ports, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejecting ports of the electrothermal transducers, and the latter discloses a structure in which openings for absorbing pressure waves caused by thermal energy are formed corresponding to the ejecting ports. Thus, irrespective of the type of the liquid ejecting head, the present invention can achieve printing positively and effectively.

In addition, the present invention can be applied to various serial-type liquid ejecting heads: a liquid ejecting head fixed to the main assembly of an image printing apparatus; a conveniently replaceable chip-type liquid ejecting head which, when loaded on the main assembly of an image printing apparatus, is electrically connected to the main assembly, and is supplied with liquid therefrom; and a cartridge-type liquid ejecting head integrally including a liquid reservoir.

It is further preferable to add a recovery system for ejecting liquid from the ejecting head in adequate condition, or a preliminary auxiliary system for a liquid ejecting head as a constituent of the image printing apparatus because they serve to make the effect of the present invention more reliable. Examples of the recovery system are a capping means and a cleaning means for the liquid ejecting head, and a pressure or suction means for the liquid ejecting head. Examples of the preliminary auxiliary system are a preliminary heating means utilizing electrothermal transducers or a combination of other heater elements and the electrothermal transducers, and a means for carrying out preliminary ejection of liquid independently of the ejection for printing. These systems are effective for reliable printing.

The number and type of liquid ejecting heads to be attached on an image printing apparatus can be also varied. For example, only one liquid ejecting head corresponding to a single color ink, or a plurality of liquid ejecting heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing. In this case, the treatment liquid (the printability enhanced liquid) for adjusting the printability of the ink may also be ejected from each individual head or a common ejecting head to the printing medium in accordance with the kind of the printing medium or the printing mode.

Furthermore, although the above-described embodiments use liguid, liquids that are liquid when the printing signal is applied can be used: for example, liquids can be employed that solidify at a temperature lower than the room temperature and are softened or liquefied in the room temperature. This is because in the ink jet system, the liquid is generally temperature adjusted in a range of 30° C.–70° C. so that the viscosity of the liquid is maintained at such a value that the liquid can be ejected reliably. In addition, the present invention can be applied to such apparatus where the liquid is liquefied just before the ejection by the thermal energy as follows so that the liquid is expelled from the ports in the liquid state, and then begins to solidify on hitting the printing medium, thereby preventing the liquid evaporation: the liquid is transformed from solid to liquid state by positively utilizing the thermal energy which would otherwise cause the temperature rise; or the liquid, which is dry when left in air, is liquefied in response to the thermal energy of the printing signal. In such cases, the liquid may be retained in recesses or through holes formed in a porous sheet as liquid or solid substances so that the liquid faces the electrothermal transducers as described in Japanese Patent Application Laying-open Nos. 54-56847 (1979) or 60-71260 (1985). The present invention is most effective when it uses the film-boiling phenomenon to expel the liquid.

Furthermore, the image printing apparatus according to the present invention can be employed not only as an image output terminal of an information processing device such as a computer, but also as an output device of a copying machine combined with a reader or the like, a facsimile apparatus having a transmission and receiving function, or a printing press for cloth. A sheet or web paper, a wooden or plastic board, a stone slab, a plate glass, metal sheet, a three dimensional structure or the like may also be used as the printing medium in accordance with the present invention.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An image printing apparatus including means for conveying a printing medium and means for scanning a carriage to move across the direction in which the printing medium is conveyed by the printing medium conveying means, the carriage being attached with a printing head for printing an image on the printing medium, said image printing apparatus comprising:

a scale disposing along the direction of scanning of the carriage by the scanning means;

a sensor for detecting the position of the carriage relative to said scale, said sensor being mounted on the carriage opposing to said scale; and a cover for covering said sensor and at least a part of said scale adjoining said sensor, said cover being provided with a guide portion for guiding said scale to a predetermined position with respect to said sensor, said cover being formed from a conductive material.

2. An image printing apparatus including means for conveying a printing medium and means for scanning a carriage to move across the direction in which the printing medium is conveyed by the printing medium conveying means, the carriage being attached to a printing head for printing an image on the printing medium, said image printing apparatus comprising:

a scale disposed along the direction of scanning of the carriage by the scanning means;

a sensor for detecting the position of the carriage relative to said scale, said sensor being mounted on the carriage opposing said scale; and a cover for covering said sensor and at least a part of said scale adjoining said sensor, said cover being provided with a guide portion for guiding said scale to a predetermined position with respect to said sensor, and said guide portion opposing said scale so that said guide portion interposes the portion of said scale corresponding to the reading center of said sensor.

3. An image printing apparatus including means for conveying a printing medium and means for scanning a carriage to move across the direction in which the printing medium is conveyed by the printing medium conveying means, the carriage being attached to a printing head for printing an image on the printing medium, said image printing apparatus comprising:

a scale disposed along the direction of scanning of the carriage by the scanning means;

a sensor for detecting the position of the carriage relative to said scale, said sensor being mounted on the carriage opposing said scale; and a cover for covering said sensor and at least a part of said scale adjoining said sensor, said cover being provided with a guide portion for guiding said scale to a predetermined position with respect to said sensor, wherein a sectional area of a central portion of said cover is larger than an end area of an opening of said cover through which said scale passes.

4. An image printing apparatus including means for conveying a printing medium and means for scanning a carriage to move across the direction in which the printing medium is conveyed by the printing medium conveying means, the carriage being attached to a printing head for printing an image on the printing medium, said image printing apparatus comprising:

a scale disposed along the direction of scanning of the carriage by the scanning means;

a sensor for detecting the position of the carriage relative to said scale, said sensor being mounted on the carriage opposing said scale; and a cover for covering said sensor and at least a part of said scale adjoining said sensor, said cover being provided with a guide portion for guiding said scale to a predetermined position with respect to said sensor, said cover further including an absorption member stored therein.

5. An image printing apparatus including means for conveying a printing medium and means for scanning a carriage to move across the direction in which the printing medium is conveyed by the printing medium conveying means, the carriage being attached to a printing head for printing an image on the printing medium, said image printing apparatus comprising:

a scale disposed along the direction of scanning of the carriage by the scanning means;

a sensor for detecting the position of the carriage relative to said scale, said sensor being mounted on the carriage opposing said scale;

a cover for covering said sensor and at least a part of said scale adjoining said sensor, said cover being provided with a guide portion for guiding said scale to a predetermined position with respect to said sensor; and means for opening/closing an opening end of said cover through which said scale passes, said opening/closing means being able to open/close said opening end of said cover.

6. The image printing apparatus as claimed in claim 5 further comprising means for controlling said opening/closing means so that said opening end of said cover is closed when said scanning means is not operated.

7. The image printing apparatus as claimed in any one of claims 1, 2, 3, 4, and 5, wherein said cover is mounted on the carriage.

8. The image printing apparatus as claimed in any one of claims 1, 2, 3, 4, and 5, wherein said cover is disposed so as to cover the full length of said scale and includes a slit for permitting said sensor which is mounted on said carriage to move within said cover along the length of said scale.

9. The image printing apparatus as claimed in any one of claims 1, 2, 3, 4, and 5, wherein said cover is partially or wholly formed from a flexible material.

10. The image printing apparatus as claimed in any one of claims 1, 2, 3, 4 and 5, wherein said guide portion prevents said sensor from coming into contact with said scale.

11. The image printing apparatus as claimed in any one of claim 1, 2, 3, 4, and 5, wherein said guide portion prevents said sensor from coming into contact with said scale even during the scanning of the carriage.

12. The image printing apparatus as claimed in any one of claims 1, 2, 3, 4, and 5, wherein the printing head is a liquid ejecting head provided with an ejecting port for ejecting liquid.

* * * * *

UNITED STATES PATENT AND TRADEMARK OFFICE

CERTIFICATE OF CORRECTION

PATENT NO. : 6,601,944 B1
DATED : August 5, 2003
INVENTOR(S) : Kenji Kawazoe

It is certified that error appears in the above-identified patent and that said Letters Patent is hereby corrected as shown below:

Title page,
Item [74], *Attorney, Agent, or Firm*, "Scinot" should read -- Scinto --.

Column 7,
Line 63, "coming" should read -- to come --.

Column 8,
Line 2, "comes" should read -- come --; and
Line 4, "has" should read -- have --.

Column 12,
Lines 55, 58, 63 and 66, "claims 1, 2, 3, 4 and 5," should read -- claims 1-5, --.

Column 13,
Line 2, "claims 1, 2, 3, 4 and 5," should read -- claims 1-5, --.

Column 14,
Line 2, "claims 1, 2, 3, 4 and 5," should read -- claims 1-5, --.

Signed and Sealed this

Third Day of February, 2004

JON W. DUDAS
*Acting Director of the United States Patent and Trademark Office*